US007942106B2

(12) United States Patent
Cromartie

(10) Patent No.: US 7,942,106 B2
(45) Date of Patent: May 17, 2011

(54) PUSH POLE FOR A BOAT

(76) Inventor: Brad Cromartie, Mount Pleasant, SC (US)

( * ) Notice: Subject to any disclaimer, the term of this patent is extended or adjusted under 35 U.S.C. 154(b) by 594 days.

(21) Appl. No.: 12/005,886

(22) Filed: Dec. 28, 2007

(65) Prior Publication Data

US 2009/0170382 A1 Jul. 2, 2009

(51) Int. Cl.
*B63B 21/54* (2006.01)
*B63H 19/08* (2006.01)

(52) U.S. Cl. ..... 114/221 R; 440/36; 294/19.1

(58) Field of Classification Search ..... 114/221 R, 114/230.1, 343; 294/19.1; 416/70 R, 71; 37/345, 346; 440/36
See application file for complete search history.

(56) References Cited

U.S. PATENT DOCUMENTS

| | | | | |
|---|---|---|---|---|
| 1,164,361 | A | 12/1915 | Kilgore | |
| 2,477,410 | A | 7/1949 | Johnson | |
| 2,787,795 | A | 6/1953 | Snodgrass | |
| 3,043,261 | A | 7/1962 | Snodgrass | |
| 3,048,139 | A * | 8/1962 | Duckett | 114/221 R |
| 3,799,099 | A | 3/1974 | Conover | 114/221 R |
| 4,121,531 | A * | 10/1978 | Norton | 114/221 R |
| 4,519,643 | A * | 5/1985 | Harris | 294/19.1 |
| 4,793,646 | A * | 12/1988 | Michaud, Jr. | 294/19.1 |
| 5,003,907 | A * | 4/1991 | Roach et al. | 114/221 R |
| 6,168,480 | B1 | 1/2001 | Schaller | 440/36 |
| 6,220,197 | B1 * | 4/2001 | Pohlman | 114/294 |

FOREIGN PATENT DOCUMENTS

FR 2629418 A3 * 10/1989

OTHER PUBLICATIONS

Cabela's World's Famous Outfitter website,www.cabelas.com, Rich-Mar Push Pole System, Sep. 26, 2007, p. 1.
Rich-Mar Sports Products website, www.richmarsports.com/Pushpole_Products.html, Sep. 26, 2007, pp. 1-4.

* cited by examiner

*Primary Examiner* — Ajay Vasudeva
(74) *Attorney, Agent, or Firm* — Thomas L. Moses; Monahan & Moses, LLC

(57) ABSTRACT

A push pole for manually propelling boats, including a shaft and a foot. In a preferred embodiment, the foot is flared at the bottom end in an inverted V-shape, and a pivoting pin is located along one side of the foot, and pivots outwardly from the foot so that it may be used to retrieve lures or as a docking hook. When the pin is not in use, it may pivot back into a receiving cavity within the side of the foot, forming a streamlined edge thereof. In one embodiment, the pivoting mechanism of the pin may include a spring to bias the pin in an outward direction, as well as means for locking the pin into the inward streamlined position when not in use. The pivoting pin may be locked into either the extended or retracted position. Further, the foot may be detachable from the shaft in any desired manner, and replaced by a net, paddle, gig, scrub brush, gaff, docking hook or spike that attaches in the same manner as the foot. Additionally, in a preferred embodiment, the push pole is buoyant in water, and includes a telescoping shaft that may be extended or retracted. A detachable hook is also disclosed.

4 Claims, 4 Drawing Sheets

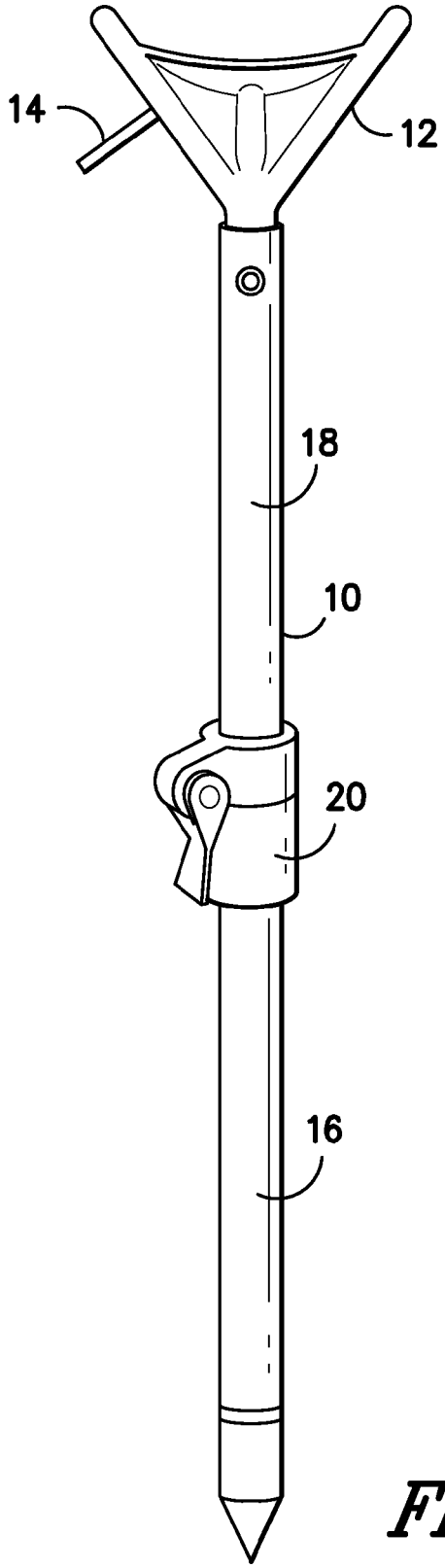
FIG. –1–
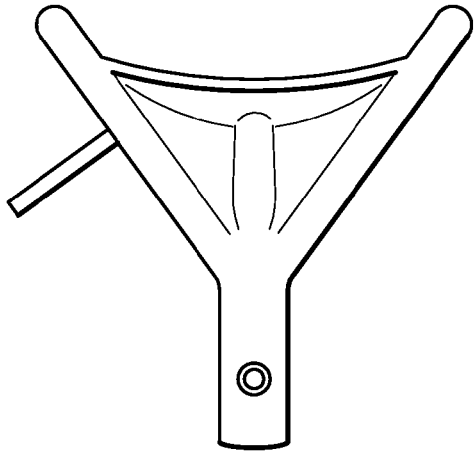
FIG. –2A–
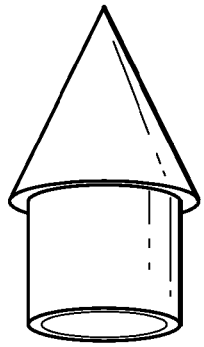
FIG. –2B–

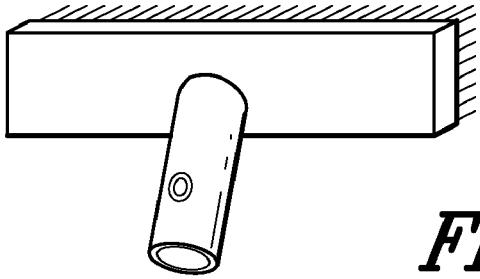
FIG. –2C–
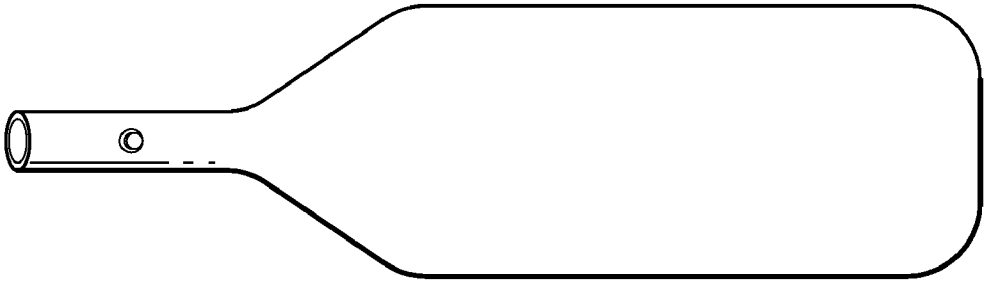
FIG. –2D–
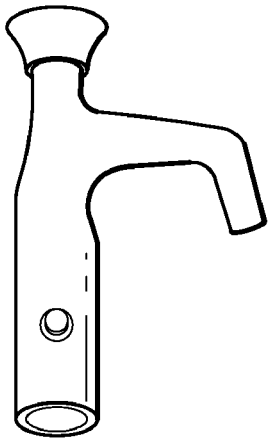
FIG. –2E–
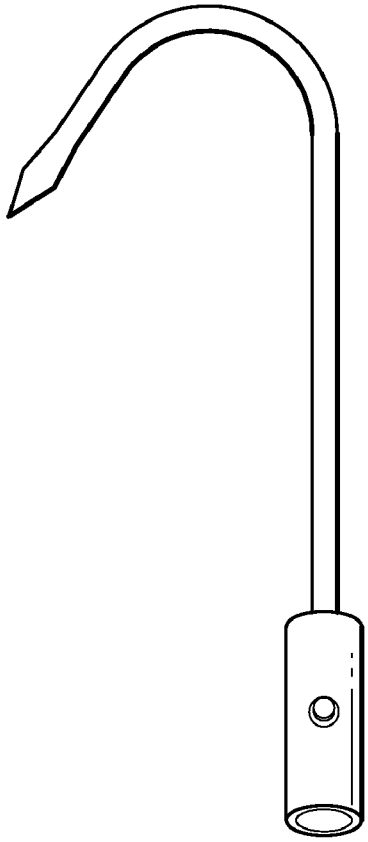
FIG. –2F–

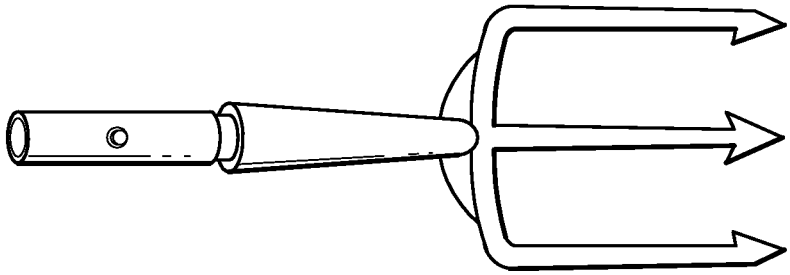
FIG. –2G–
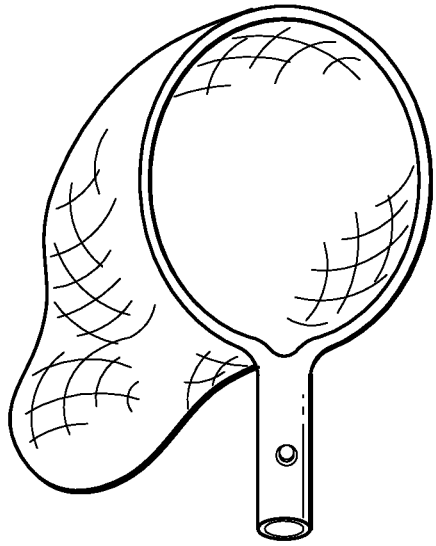
FIG. –2H–
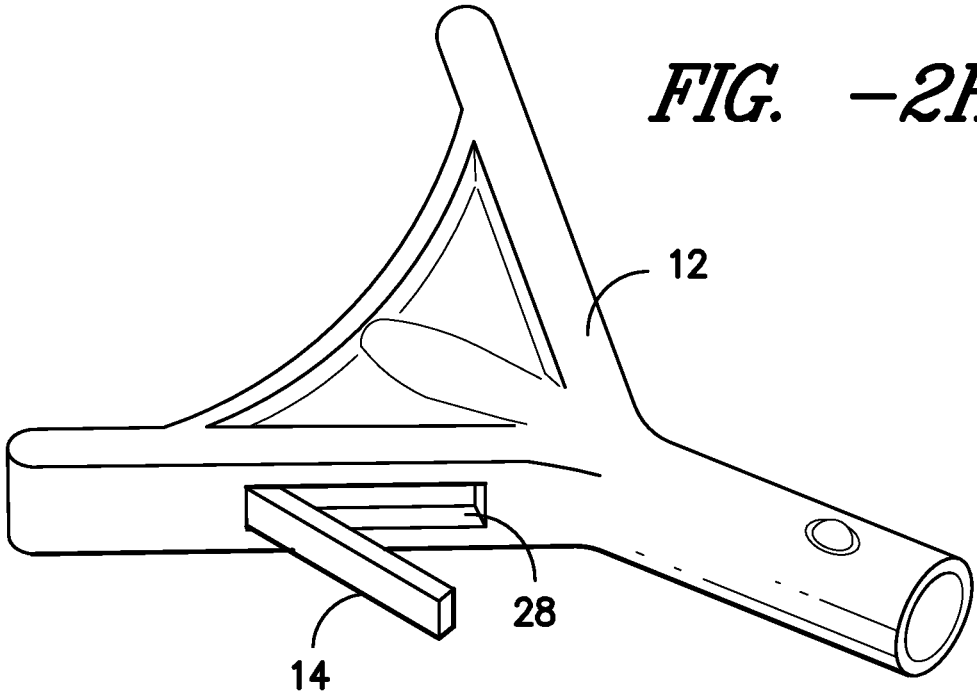
FIG. –3–

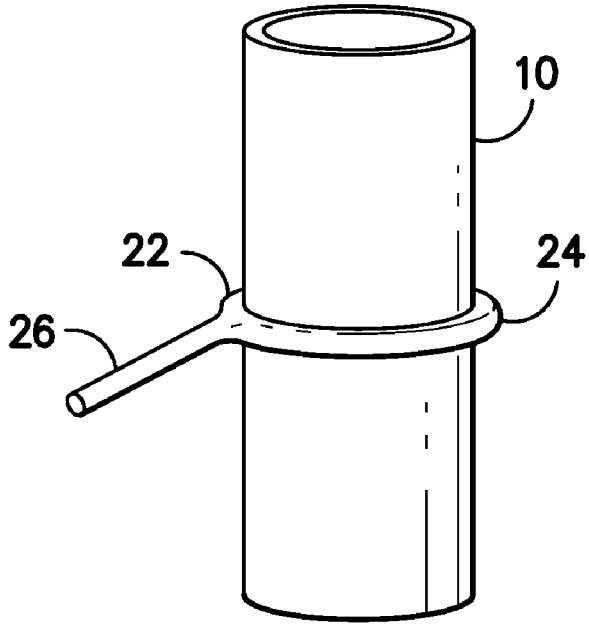
FIG. –4–
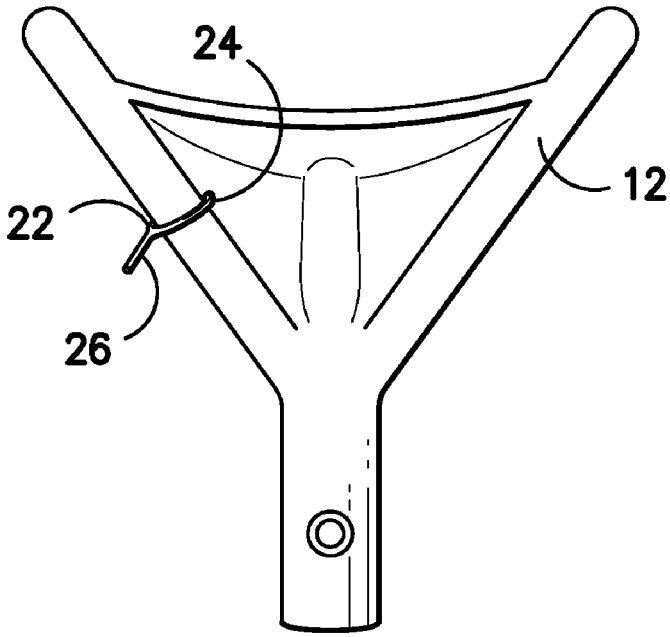
FIG. –5–

PUSH POLE FOR A BOAT

FIELD OF THE INVENTION

The invention relates generally to push poles for manually propelling a boat, and more specifically to a push pole having interchangeable parts, including a foot including a pivoting pin or lever that may be folded outwardly for retrieving a lure or for use as a docking hook, and other attachable accessories which may adapt the pole to be used as a gaff, net, docking hook, scrub brush, paddle, gig, spike or other accessories.

BACKGROUND OF THE INVENTION

Many different boats are used in shallow waterways, such as streams, creeks, swamps and flats. Oftentimes, boat owners using such boats wish to move the boat without causing a disturbance around the boat which could disrupt marine life nearby. Push poles may be used for such purposes. Most push poles available today include a long shaft and a foot (typically called a duck foot) that is flared at the bottom end in an inverted V-shape so that the push pole will not become stuck or lodged in the mud.

Many such push poles are expensive, and have one sole, primary use—propelling the boat by manually using the push pole to push against the bottom of the waterway. However, it would be useful to provide a floating push pole that included interchangeable parts, where the foot could be removed from the shaft, and replaced by a net, docking hook, scrub brush, gaff, paddle, gig, spike or other accessories. Further, it would be desirable to provide a push pole having a foot that includes a pivoting pin that may be folded outwardly for retrieving a lure, duck decoy or other equipment from the water, or for use as a docking hook, and that may be folded inwardly to a position within the foot when not in use. Additionally, another optional feature of the push pole is that the shaft may be formed into a telescoping relation so that it may be extended or retracted, as desired.

SUMMARY OF THE INVENTION

The object of the present invention is to provide a push pole for manually propelling boats, including a shaft and a foot. In a preferred embodiment, the foot is flared at the bottom end in an inverted V-shape, and a pivoting pin is located along a portion or side of the foot, and pivots outwardly from the foot so that it may be used to retrieve lures, duck decoys, or other equipment or items from the water, or used as a docking hook. When the pin is not in use, it may pivot back into a receiving cavity within the side of the foot, forming a streamlined edge thereof. In one embodiment, the pivoting mechanism of the pin may include a spring to bias the pin in an outward direction, as well as means for locking the pin into the inward streamlined position when not in use. The pivoting pin may be locked into either the extended or retracted position. Further, the foot may be detachable from the shaft in any desired manner, and replaced by a net, paddle, gig, gaff, scrub brush, docking hook, spike or other attachments that attach in the same manner as the foot. Additionally, in a preferred embodiment, the push pole is buoyant in water, and includes a telescoping shaft that may be extended or retracted.

BRIEF DESCRIPTION OF THE DRAWINGS

FIG. 1 is a perspective view of the push pole including a telescoping shaft and a removable V-shaped foot with a pivoting pin shown in the extended position;

FIGS. 2A-H are perspective views of the accessories that may be attached to the shaft, including a foot member (FIG. 2A), a spike (FIG. 2B), a push broom (FIG. 2C), a paddle (FIG. 2D), a boat hook (FIG. 2E), a gaff (FIG. 2F), a gig (FIG. 2G), and a net (FIG. 2H);

FIG. 3 is a perspective view of a removable V-shaped foot, showing the pivoting pin in the extended position, and showing the cavity formed in the side of the foot for receiving the pivoting pin when it is disposed in a retracted position;

FIG. 4 is a perspective view of a hook attachment that may be attached to the shaft of a push pole for use as a docking hook, lure retriever, decoy retriever or the like; and FIG. 5 is a perspective view of a hook attachment that is attached to one side of a V-shaped foot for use as a docking hook, lure retriever, decoy retriever or the like.

DETAILED DESCRIPTION OF THE INVENTION

FIG. 1 illustrates a first embodiment of the proposed push pole having a telescoping tubular shaft 10 and a detachable foot member 12 having a V-shape and a pivoting pin 14 along one side of the foot. The pivoting pin 14 may be in the extended position, where the pin extends away from the foot 12 so that it may be used to retrieve lures or used as a docking hook. When not in use, the pivoting pin 14 may be placed into a retracted position within a cavity 28 in the foot forming a streamlined edge thereof. In one embodiment, the pivoting mechanism of the pin may include a spring to bias the pin in an outward or extended direction, as well as means for locking the pin into the inward or retracted position when not in use. In a preferred embodiment, the foot member is made from urethane or a urethane product in an injection molding process. One advantage to using urethane products for the manufacture of the foot is that sound does not resonate as loudly through urethane products as it does with other materials, which is a desirable feature for push poles for boats.

The shaft 10 may be formed to extend or retract telescopically in measured increments (for instance by using a spring loaded pin on one telescoping portion that engages spaced holes on the other telescoping portion), or it may be infinitely adjustable (by using a twist-locking and unlocking mechanism or a locking release 20 as shown in FIG. 1, for example). The shaft includes a first end 16, which may include a handle portion and/or a spike member, and a second end 18 to which may be attached the foot or any of the other accessories mentioned herein. Alternatively, the shaft need not be telescoping.

The foot 12 may be detachable, as shown in FIG. 3, so that it may be replaced with other accessories, such as a net, paddle, gaff, gig, push broom, docking hook or spike, as shown in FIGS. 2A-H. The foot 12 and the other attachments may be removably attached using any suitable means, such as a threaded portion that screws into the shaft, or a locking pin mechanism, by way of illustration. In one embodiment, the shaft of the push pole is buoyant, so that if the push pole is dropped into the water, it will float so that an operator may easily retrieve it. The components of the push pole may be made from any suitable material, including wood, plastic, metal, fiberglass, urethane or rubber substances, as well as a coating of polyurethane or similar substance may be applied to any wood components for protection against water, pests, mold and rot. In an alternate embodiment, the spike may be placed on a first end 16, while the attachment mechanism for receiving the accessories of FIGS. 2A-H may be disposed on a second end 18 of the shaft member (as shown in FIG. 1).

This arrangement allows a user to have a single tool that may be adapted to many uses, and reduces the amount of equipment that must be carried and stored in a boat. When the foot is attached, the push pole may be used to manually propel the boat, and the pivoting pin may be extended in order to retrieve a lure, equipment that may have fallen overboard, or used as a docking hook in order to pull the boat up to a dock or another boat. By removing the foot, the user may attach a net for netting fish, a gig for gigging fish or frogs, a spike for inserting the pole into the ground, creek bed or bottom of a waterway, a paddle for propulsion in deeper water, a scrub brush, a gaff for retrieving fish or a docking hook attachment.

In another embodiment of the proposed invention, a detachable hook 22 is provided, as shown in FIGS. 4 and 5. The detachable hook includes attachment means 24 and a hook member 26. The attachment means may include a flexible collar that snaps around the shaft member above the foot (FIG. 4) or onto the foot itself (FIG. 5), and preferably includes a gripping surface, such as rubber, that frictionally engages a shaft, pole or foot upon attachment. When the detachable hook is attached to the shaft of the push pole or foot, it may be used similarly to the pivoting pin in the above-referenced embodiment for retrieving lures, decoys, equipment and the like, and as a docking hook for hooking onto a dock to pull the boat alongside.

Although the present invention has been described in considerable detail with reference to certain preferred versions thereof, other versions are possible. Therefore, the spirit and scope of the appended claims should not be limited to the description of the preferred versions contained herein. All features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A push pole assembly for propelling a boat comprising:

a telescoping push pole having a first shaft member and a second shaft member, said first shaft member being telescopically adjustable with respect to said second shaft member, wherein said telescoping push pole is buoyant in water;

a first accessory, said first accessory being detachably attached at a distal end of one of said first shaft member and said second shaft member, said first accessory being selected from the group consisting of a handle and a spike member;

a foot member, said foot member having a generally inverse V-shaped body, said foot member being detachably attached at a distal end of the other of said first shaft member and said second shaft member;

a pivoting pin, said pivoting pin being pivotally mounted in a cavity along one side of said V-shaped body of said foot member, said pivoting pin movable between a first retracted position and a second extended position, wherein when in the first retracted position said pivoting pin is flush with an outer surface of the foot member, and wherein when in the second extended position said pivoting pin extends away from the foot member and is configured for retrieving lures or use as a docking or boat hook.

2. The push pole assembly of claim 1, further comprising a second accessory, said second accessory being adapted to be detachably attached at the respective distal end of one of said shaft members to replace said foot member, wherein said second accessory is selected from the group consisting of a gaff member, a net member, a scrub brush, a docking hook, a paddle, and a gig member.

3. The push pole assembly of claim 1, wherein the length of said telescoping push pole is infinitely adjustable between a retracted minimum length and an extended maximum length.

4. The push pole assembly of claim 1, wherein said first shaft member and second shaft member each comprises tubular shaft.

* * * * *